US008702528B1

(12) United States Patent
Montgomery

(10) Patent No.: US 8,702,528 B1
(45) Date of Patent: Apr. 22, 2014

(54) PUTTING PRACTICE APPARATUS

(76) Inventor: Neil E. Montgomery, Venetia, PA (US)

( * ) Notice: Subject to any disclaimer, the term of this patent is extended or adjusted under 35 U.S.C. 154(b) by 309 days.

(21) Appl. No.: 13/172,418

(22) Filed: Jun. 29, 2011

Related U.S. Application Data

(60) Provisional application No. 61/359,866, filed on Jun. 30, 2010.

(51) Int. Cl.
*A63B 69/36* (2006.01)

(52) U.S. Cl.
USPC ..... 473/157; 473/150; 473/278; 473/173

(58) Field of Classification Search
USPC ..... 473/159, 278, 173, 174, 157, 150
See application file for complete search history.

(56) References Cited

U.S. PATENT DOCUMENTS

| | | | | | |
|---|---|---|---|---|---|
| 1,338,963 | A | * | 5/1920 | Rolfe | 473/162 |
| 1,687,217 | A | | 10/1928 | Kurtz | |
| 2,678,823 | A | | 5/1954 | Hugman | |
| 3,232,619 | A | | 2/1966 | Burk | |
| 3,427,030 | A | | 2/1969 | Ward | |
| 3,584,877 | A | * | 6/1971 | Florian | 473/159 |
| 4,203,604 | A | * | 5/1980 | La Grange | 473/162 |
| 4,596,391 | A | | 6/1986 | Carolan, Jr. | |
| 4,743,026 | A | * | 5/1988 | Eady | 473/162 |
| 4,877,250 | A | * | 10/1989 | Centafanti | 473/157 |
| 4,957,288 | A | | 9/1990 | Kantner et al. | |
| 4,988,106 | A | * | 1/1991 | Coonrod | 473/160 |
| 5,042,813 | A | | 8/1991 | Huang | |
| D347,661 | S | | 6/1994 | Dickson | |
| 5,607,360 | A | | 3/1997 | Shiffman | |
| D385,007 | S | * | 10/1997 | Perrin | D21/792 |
| 5,738,594 | A | * | 4/1998 | Kinney | 473/171 |
| 5,863,256 | A | * | 1/1999 | MacLean et al. | 473/160 |
| D407,458 | S | * | 3/1999 | Soonlan | D21/792 |
| 6,419,590 | B1 | | 7/2002 | Criger | |
| 6,569,027 | B2 | * | 5/2003 | Florian | 473/160 |
| 6,769,993 | B1 | * | 8/2004 | Lasalandra | 473/193 |
| 6,837,797 | B2 | | 1/2005 | Hull | |
| D632,749 | S | * | 2/2011 | Montgomery | D21/791 |
| 2002/0039929 | A1 | * | 4/2002 | Morris | 473/157 |
| 2004/0224783 | A1 | * | 11/2004 | Lee | 473/157 |
| 2004/0259654 | A1 | * | 12/2004 | Failla et al. | 473/230 |
| 2005/0153788 | A1 | * | 7/2005 | Saldana | 473/173 |
| 2006/0276255 | A1 | * | 12/2006 | Hutchison | 473/159 |
| 2007/0135224 | A1 | * | 6/2007 | Miller | 473/159 |
| 2007/0259727 | A1 | * | 11/2007 | Westaway et al. | 473/157 |
| 2008/0200272 | A1 | * | 8/2008 | Shin | 473/157 |
| 2008/0200273 | A1 | * | 8/2008 | Kleppert | 473/186 |

* cited by examiner

*Primary Examiner* — Raleigh W Chiu
(74) *Attorney, Agent, or Firm* — Montgomery Patent & Design; Robert C. Montgomery

(57) ABSTRACT

The training aid for practicing the skill of putting a golf ball in a straight direction is comprised of a kit which provides developmental drills to allow the avid golfer or participant an opportunity to improve their putting skills. The kit comprises a playing surface with various indicia and a set of target balls which enables the participant(s) to play various games which correspond to golfing. A base mat is placed underneath the playing surface and further has a perimeter rim to retain errant golf balls when exiting the playing surface. An auxiliary attachable backstop, a plurality of removably attachable standing platforms, and a detachable putter are also provided.

20 Claims, 9 Drawing Sheets

PUTTING PRACTICE APPARATUS

RELATED APPLICATIONS

This utility patent application is a continuation of the provisional patent application filed with the United States Patent and Trademark Office on Jun. 30, 2010 and referenced by No. 61/359,866.

FIELD OF THE INVENTION

The present invention relates generally to a system for improving one's skills in putting a golf ball and, more particularly, for developing the skills of controlling putting distance, controlling putting speed, and focusing visual concentration within the framework of a game format, all of which are and executed upon an artificial grass mat.

BACKGROUND OF THE INVENTION

Putting is generally considered the single most important skill required for a golfer. Consequently, putting is the one area where a golfer can most quickly improve scoring. Although virtually anyone can putt a golf ball, training towards competency and, ultimately, perfection is difficult as it requires hours of practice. Practice alone often becomes tedious; therefore, educators and coaches usually employ supplemental training materials to teach skills and to encourage practicing. These supplemental materials are designed around developing skill sets, while also being enjoyable and game-like, thus relieving training tedium. As a result, the invention herein described fulfills the need for supplemental golf putting instructional materials for developing specific putting skills and, at the same time, is enjoyable to do by oneself or with others who may or may not be golfers.

Several attempts have been made in the past to provide either golf putting games that provide no real system for improving putting skills, or training contraptions and methods that do not relieve the tedium of practicing.

No prior art discloses a combination of skill training and game-like conditions for participation by one to four people, whether or not they are golfers.

No prior art discloses a practice mat that is consistently flat and has indicia allowing for a plurality of skill training games and putting targets that can be used in either or both lengthwise directions.

No prior art discloses a practice mat that is selectively adjustable to provide textures and slopes for advanced users.

No prior art discloses a modular system that provides selectable mat configurations to enable a plurality of game styles and practice styles based upon user preferences.

No prior art discloses a system with all of these features which is fully collapsible for ease of storage and transport.

U.S. Pat. No. 2,678,823, in the name of Hugman, discloses a gutter area of an indoor putting game, comprising an undulating floor portion, a ball rack, and a curtain.

U.S. Pat. No. 3,584,877, in the name of Florian, describes a golf game utilizing a runner that simulates a golfing green with a targeted area that has a scoring means and an inclined portion with a ball-receiving cup. The present invention does not include an inclined plane or backboard and also describes and provides alternate games to be played on the playable surface.

U.S. Pat. No. 4,203,604, in the name of La Grange, teaches a golf game, utilizing a flexible elongated mat with a plurality of openings simulating holes on a golf course and a plurality of playing cards used in conjunction with a scoring scheme.

Unfortunately, the present invention does not use a series of target holes that simulates holes on a golf course and, as such, differs in scope from the La Grange device.

U.S. Pat. No. 4,596,391, in the name of Carolan, Jr., discloses a portable golf game, utilizing a putter (said device having a walled and substantially planar playing surface), a target hole at one (1) end, at least one (1) obstacle, and wherein at least two (2) portions of the playing surface are selectively joinable to create a carrying case. The Carolan, Jr. device simulates a miniature golf hole, whereas the present invention is a planar surface with multiple target locations for training a user to putt straight at a target.

U.S. Pat. No. 4,743,026, in the name of Eady, describes a golf game having a flexible playing medium with one region for simulating non-putting shots and one (1) for simulating putting shots, and also has a series of charts depicting different regions on a golf course, wherein when said golf ball is putted to a chart delineating positioning the ball onto the putting region, the player's next shot is played in that region. The Eady device comprises a different playing scheme and device than that of the present invention, which assists in training a user to select a target and putt a ball towards that target with a straight stroke.

U.S. Pat. No. 4,877,250, in the name of Centafanti, discloses a portable golf putting course consisting of a flexible barrier surrounding a target area, which contains a plurality of objectives painted on the playing surface. The Centafanti device differs in scope in that it does not provide a scoring scheme similar to that of the present invention and also does not provide alternate games using the same playing surface.

U.S. Pat. No. 4,957,288, in the name of Kantner et al., teaches a golf putting game consisting of an angular framework, supporting a felt mat and pockets within the framework. The Kantner et al. device simulates the game of billiards, utilizing the tools of the game of golf and therefore differs in scope from the present invention.

U.S. Pat. No. 5,042,813, in the name of Huang, describes an indoor golf training course, including a teeing ground unit, a gutter ball return, a ball chamber, and a counting net foldably mounted on the back end of the teeing unit, incorporating a nested holder with various holes and wire channels for counting the score where a golf ball was driven in. Unfortunately, the Huang device is a complicated targeting device for scoring and identifying driven golf balls, whereas the present device has no moving parts and is easily portable and maneuverable and assists in training a user to putt a golf ball in a straight direction at an intended target.

U.S. Pat. No. 5,607,360, in the name of Shiffman, discloses a golf putting game apparatus comprising a scoring template to be placed on an existing playing surface, including a hole marking means, scoring zone marking means, and a holed-out zone marking means. When a golf ball is putted with the proper amount of speed and accuracy, it will settle into the desired zone. Scoring indicia are marked on the template. The Shiffman device does not provide a unitary mat that is portable and can be placed on any surface to train the skill of putting a golf ball at a selected target.

U.S. Pat. No. 5,738,594, in the name of Kinney, teaches a mat with a top surface that has a plurality of scoring areas marked thereon, including a boundary line that divides the top surface into two (2) longitudinal zones. The Kinney device does not provide a shuffleboard-like target scoring area as in the present invention and also does not provide a mat with a non-slip backing to allow it to be placed on any surface. Additionally, the Kinney device is not similarly equipped with alternate gaming strategies and equipment.

U.S. Pat. No. 5,863,256, in the name of MacLean et al., describes a portable putting surface comprising a plurality of separate panels mated together, said panels having a slope-adjusting means and side rails. A continuous length of artificial grass is placed overtop the mated panels and has a teeing section and a golf hole section. The MacLean et al. device differs from the present invention in that it includes a plurality of panels that must be attached together to make a playing surface. The present invention is meant to be simply rolled out onto a planar surface, (the better to practice straight putting), and does not have a ball-receiving hole as a target.

U.S. Pat. No. 6,419,590, in the name of Criger, discloses a scoring overlay in the form of a circular target with scoring indicia. The Criger device is designed to be placed overtop the golf hole after the golf putt has been made to determine the accuracy of the golf putt and adding scores based on the position. As such, the Criger device differs in scope from the present invention.

U.S. Pat. No. 6,837,797, in the name of Hull, teaches a method for playing a putting game on a golf green surface, wherein each player has a unique golf ball. All balls are placed on the circumference of a selected radius with the cup at the center. Each ball is putted until the ball enters the cup or is putted twice. A scoring scheme is based on each round.

None of the prior art particularly describes an invention that is both a golf ball putting training system and also a recreational game that can be played by one (1) or more participants, whether or not they are golfers. Accordingly, the need exists for supplemental training materials for the development of the golf ball putting skills of speed control, roll line, and visual focusing in a format that can also be used as a game played upon a portable flat surface.

SUMMARY OF THE INVENTION

In view of the foregoing disadvantages inherent in the prior art, it has been observed that nothing addresses the need for supplemental training aids for practicing the skill of putting a golf ball that relieves the tedium of practicing and can also be played and enjoyed by individuals of various skill and age levels.

The supplemental training materials herein disclosed utilize game situations involving putting a golf ball that can involve friends and family, while providing the more serious golfer with an opportunity to improve putting skills. The supplemental games are performed within an area of limited space that forces the participants to focus on the target and concentrate on the basic skills of putting in order to achieve the desired target.

The game-oriented system for improving putting is primarily directed toward visual focusing, distance control, and achieving proper roll line within a ten (10) foot down range. It is generally accepted that improving scoring is best accomplished on a regular golf course by sinking a significant majority of putts in the two (2) to ten (10) foot length.

It is common on an actual putting green on a golf course that the line of a putt will seldom be perfectly straight and flat. Reading the texture, slopes, and undulations of the green is another important putting skill required of a successful putter. However, unless a golfer can properly focus and concentrate on the task and then putt a golf ball directly to a selected target with the proper speed, reading the green correctly will do no good. Thus, the training system of this invention teaches the essence of putting, which is at the base of a person using a putter to strike a golf ball and roll said ball into the hole. The training system of the invention further allows a person to selectively utilize profile inserts to add texture, slopes, and undulations to the mat in order to practice those skills.

Although the games serving as the supplemental training materials can stand separately as traditional games modified to use golf balls and a putter, a golfer determined to improve his or her putting skills will gain valuable experience and practice time. By using games that are somewhat related to known games, that are easy to learn to play, and that are fun and enjoyable will encourage golfers and non-golfers to play the games and to employ a system for improving putting skills.

Because the putting games can be played and enjoyed by people of all ages and skill levels, golfers can enjoy social interaction with non-golfing friends and family, while having the simultaneous benefit of training their putting stroke. The games can likewise be played exclusively by serious golfers, thus affording each golfer with training in concentration, directional putting, and control of speed within a competitive by enjoyable environment.

A golfer can individually use the mat. Competitors are not always necessary. Individual practice allows sufficient time for the golfer to concentrate on form and stroke, which are necessary to improving putting skills.

The system uses an artificial grass that has the texture and attributes of a typical golf green with a non-skid base surface.

The grass mat is imprinted with the playing surface used for the supplemental training games. The imprinting can likewise be used as target areas when practicing by oneself. The mat is imprinted in such a manner as to allow games to be played in both length-wise directions, thus accommodating up to four (4) participants.

The grass mat is made from artificial olefin fibers, or similarly suitable manufactured carpet fibers, with a slip-resistant synthetic backing and, thus, can be used equally well either indoors or outside.

The mat can be utilized with one (1) or more standing platforms along a side of the grass mat that provide a standing area for a user to putt a golf ball that is on the mat. The standing platforms provide a similar surface to the grass mat that is level with the grass mat to better simulate actual golfing conditions. The standing platforms can attach to the mat with a locking feature and can be removed and stored as desired.

The mat can be utilized with a backstop or with a semi-circular barrier in order to contain the golf balls to the mat. This in turn saves time collecting the balls, prevents the balls from becoming lost, prevents damage to the home or surrounding area, and enables additional game-play opportunities.

The mat is designed and dimensioned to both serve its training purposes and to be used in a hallway, living room or other areas of limited space.

The mat is further designed to allow for it to be conveniently rolled up for storage when not in use.

The system can further include one (1) or more modular practice putters each comprising a handle section, a middle section, a head section, and a plurality of threaded portions used to attach said sections. The practice putters, when assembled, function similarly to conventional putters, but can be collapsed for ease of storage and transportation.

The innovative training system for golf putting in a game format fulfills the identified need of providing a method of improving the most critical set of trainable motor skills involved with putting a golf ball, as well as providing an enjoyable set of recreational games.

BRIEF DESCRIPTION OF THE DRAWINGS

The advantages and features of the present invention will become better understood with reference to the following more detailed description and claims taken in conjunction with the accompanying drawings in which like elements are identified with like symbols and in which:

DESCRIPTIVE KEY

Figure 1:
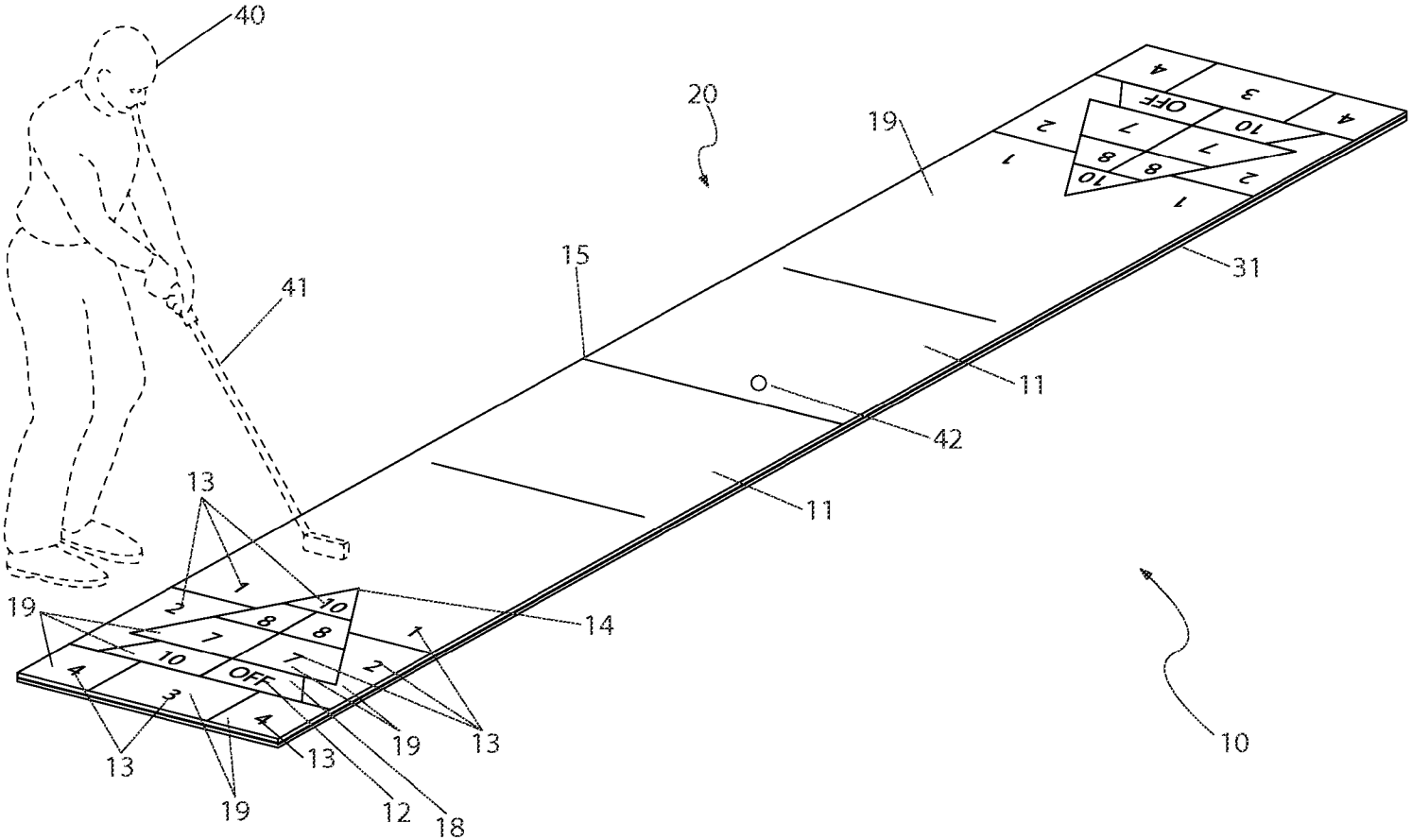
FIG. 1 is a perspective view of a training aid for practicing the skill of putting a golf ball in a straight direction 10, according to the preferred embodiment of the present invention.

10 training aid for practicing putting a golf ball in a straight direction
11 center section
12 "OFF" indicia
13 scoring indicia
14 scoring borders indicia
15 center line
18 "OFF" section
19 scoring section
20 mat
30 primary backing
31 secondary backing
40 participant
41 golf club
42 golf ball
70 modular practice putter
72 handle section
74 middle section
76 head section
78 threaded portion
80 base mat
82 rim
83 standing platform
84 locking feature
86 hook-and-loop strap
88 barrier
90 profile insert
100 horseshoe arrangement
101 horseshoe
105 shuffleboard arrangement
110 bocce arrangement
111 backstop
112 upper panel
113 lower panel
120 floor surface

DETAILED DESCRIPTION OF THE PREFERRED EMBODIMENT

Figure 2:
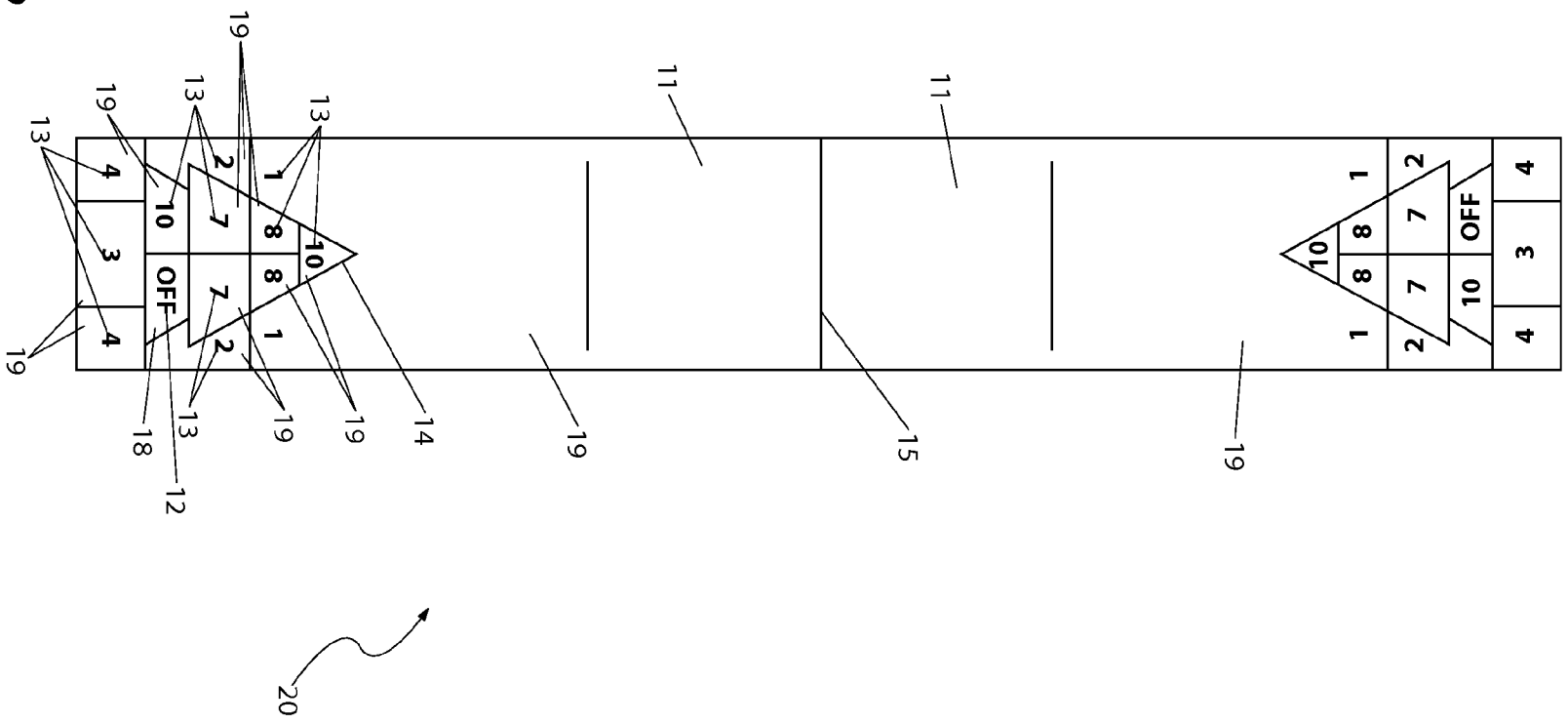
FIG. 2 is a top plan view of the training aid for practicing the skill of putting a golf ball in a straight direction 10, according to the preferred embodiment of the present invention.
Figure 3:
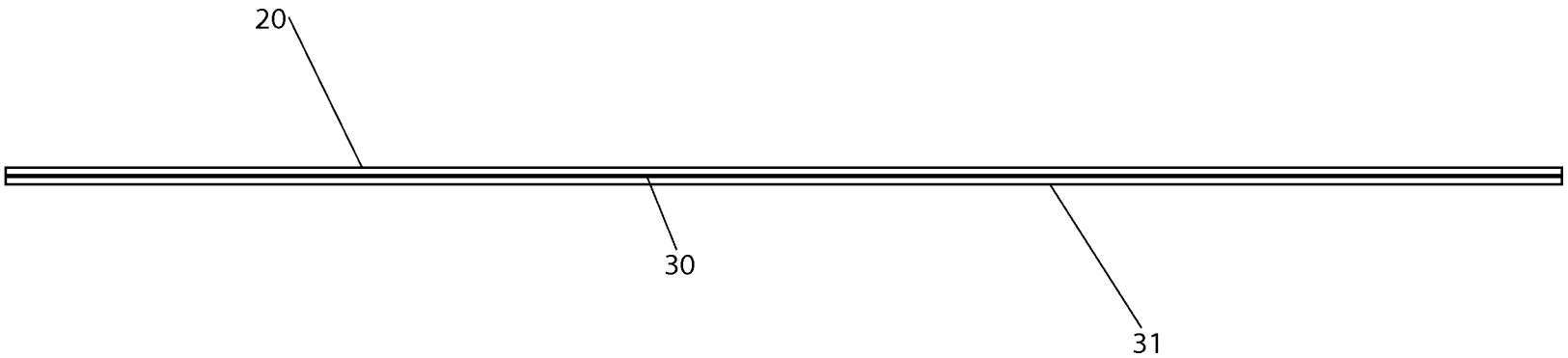
FIG. 3 is a side view of the training aid for practicing the skill of putting a golf ball in a straight direction 10, according to the preferred embodiment of the present invention.

The best mode for carrying out the invention is presented in terms of its preferred embodiment, herein depicted within FIGS. 1 through 3 and in terms of alternate embodiments as depicted within FIGS. 4 through 9. However, the invention is not limited to the described embodiment, and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a training aid for practicing the skill of putting a golf ball in a straight direction (herein described as the "kit") 10, which provides a means for practicing the art of putting for the game of golf.

Referring now to FIG. 1, a perspective view of the kit 10, FIG. 2, a top plan view of the kit 10, and FIG. 3, a side view of the kit 10, according to a preferred embodiment of the present invention, are disclosed. The kit 10 enables a participant 40 to improve their skills in putting a golf ball 42 and, more particularly, for developing the skills of putting straight, controlling putting distance and speed, and focus. Integral to kit 10 is an artificial grass mat 20 with a non-slip primary backing 30. The grass mat 20 would be constructed of cut fibers of synthetic materials such as, but not limited to, olefin or nylon fibers that are stitched into a primary backing 30 that is attached with a latex adhesive compound to a non-skid secondary backing. Both the primary 30 and a secondary 31 backings are constructed from mildew-resistant materials. The mat 20 is cut to a height that is dense and short to replicate the characteristics of a golf course's putting green.

The mat 20 is two (2) feet wide by ten (10) feet in length. Other lengths may be used; however, the two (2) foot width is dimensioned as to visually focus a participants 40 attention on a target on the mat 20 in order to improve concentration during the act of putting. The mat 20 is flexible so as to allow it to be rolled up for convenient storage or to be quickly unrolled for use either indoors or outdoors. The top or face of the mat 20 has imprinting for the various games on both ends so that it can be used equally in either direction. Scoring border indicia 14 segments each opposing lower ends of the mat 20 into scoring sections 19 and an "OFF" scoring section 18, labeled with scoring indicia 13 and "OFF" indicia 12, respectively. A plain center section 11 is located on each side of the mat 20 above the scoring sections 13 and is bisected with a horizontal center line 15 to separate the two (2) halves.

When a participant 40 utilizes the invention by themselves while practicing the skill of putting a golf ball 42 with a golf club 41, a target area is selected by the participant 40 from the mat's 20 indicia, most typically a scoring section 19. In this case, the participant 40 is visually focused on the target by both the restricted width of the mat 20 and the imprinted scoring section 19 on the mat 20. To complete the practice session, the participant 40 would direct their attention to the proper stroke to strike the golf ball 42 and have it roll straight and true, with the correct speed, to the selected target. The participant 40 may elect to putt one (1) or more balls 42 in succession in one (1) direction and then collect the balls 42 and return putt to another target in the opposite direction.

Figure 4:
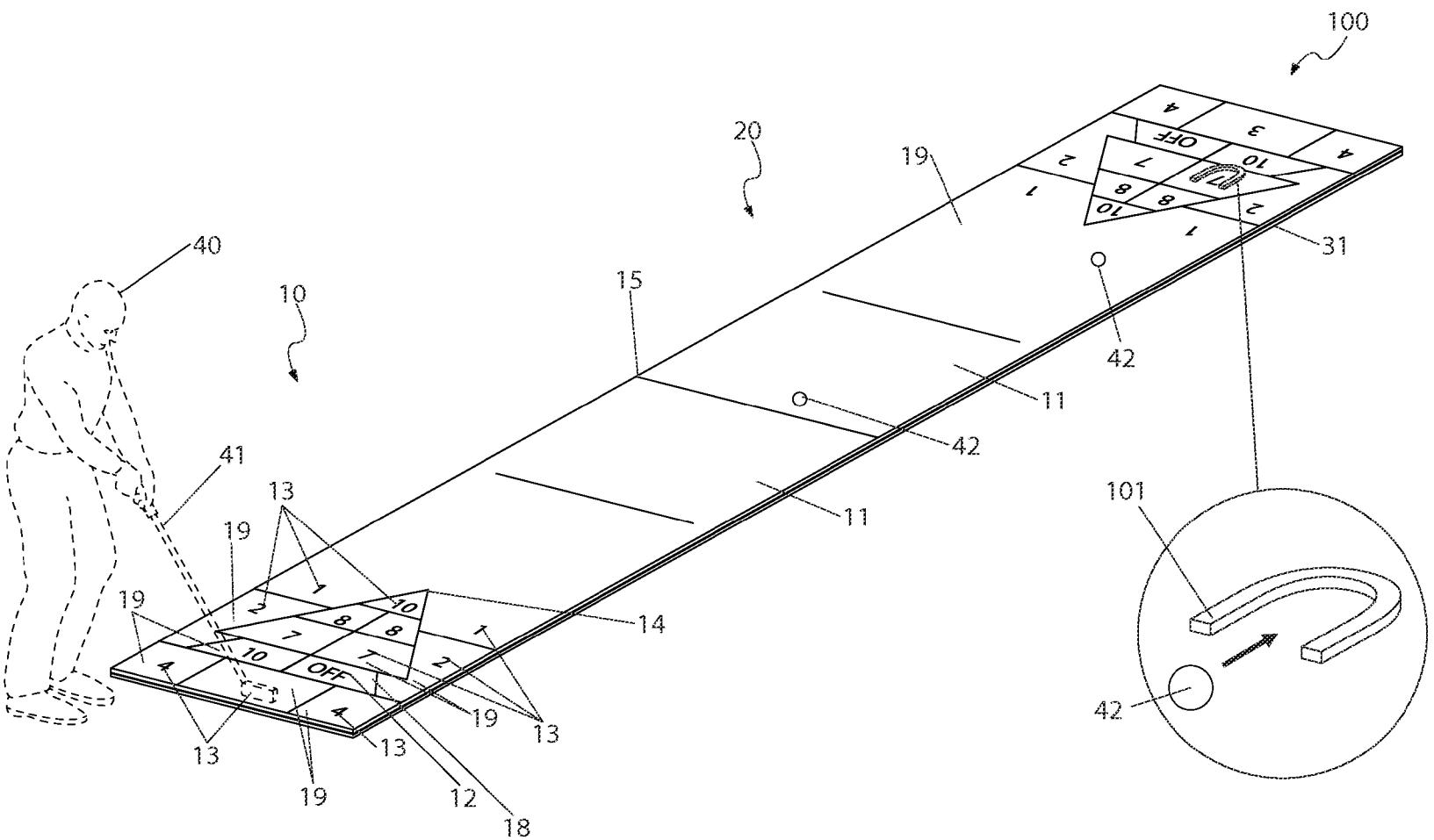
FIG. 4 a perspective view of the training aid for practicing the skill of putting a golf ball in a straight direction 10 depicting a horseshoe arrangement 100, according to the preferred embodiment of the present invention.
Figure 5:
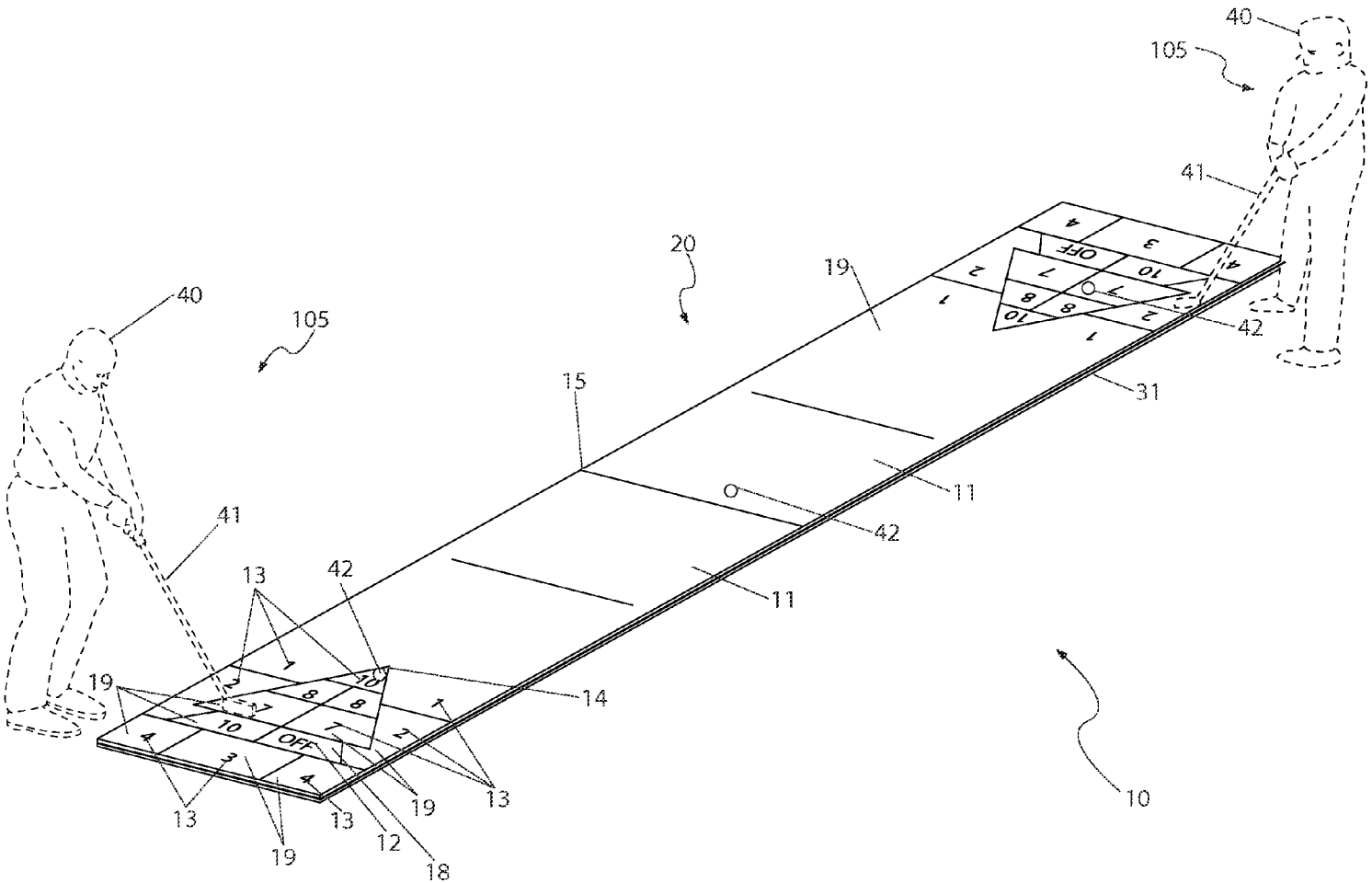
FIG. 5 a perspective view of the training aid for practicing the skill of putting a golf ball in a straight direction 10 depicting a shuffleboard arrangement 105, according to the preferred embodiment of the present invention.
Figure 6:
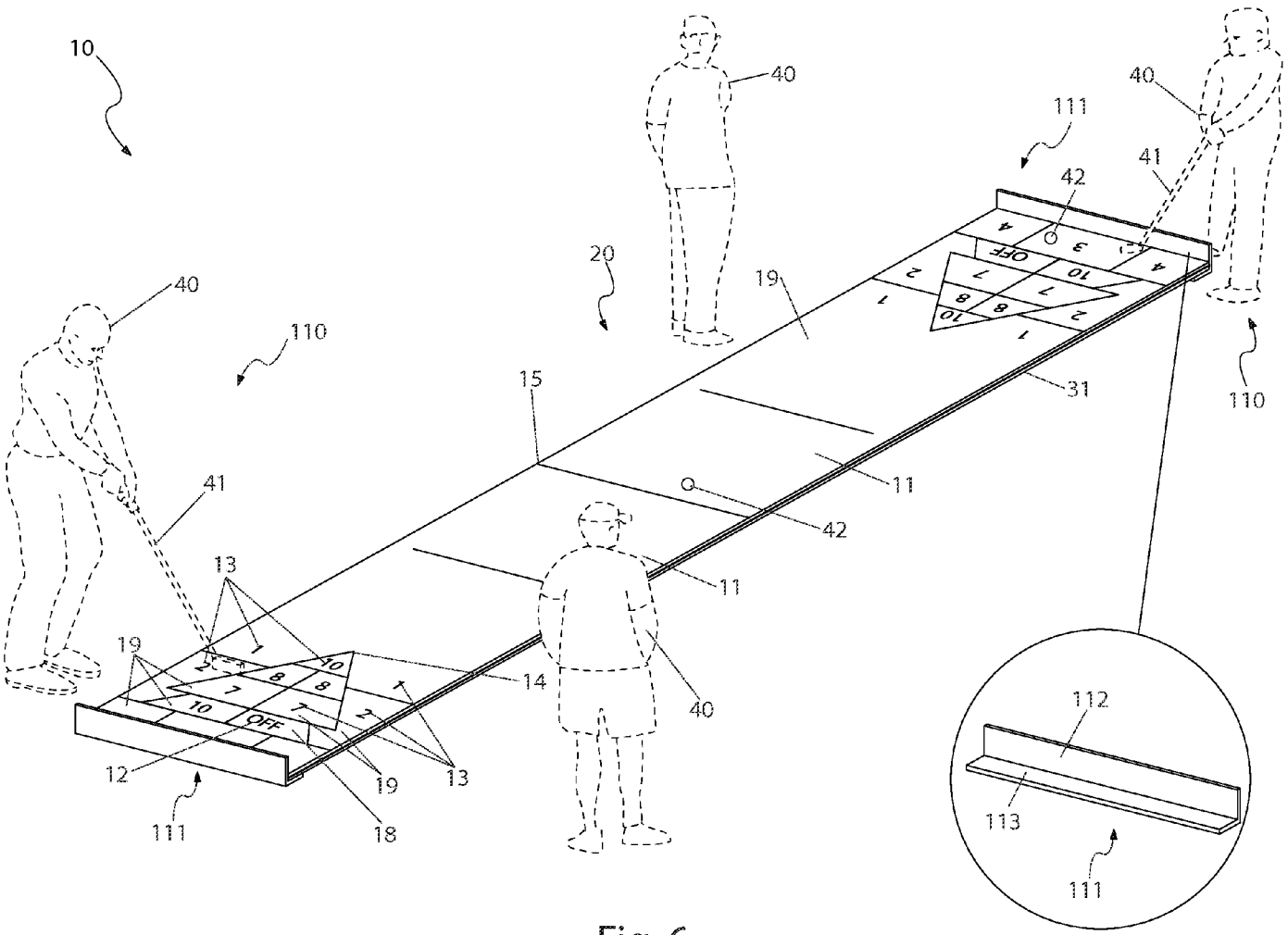
FIG. 6 a perspective view of the training aid for practicing the skill of putting a golf ball in a straight direction 10 depicting a bocce arrangement 110, according to the preferred embodiment of the present invention.

Referring now to FIG. 4, a perspective view of the kit 10 depicting a horseshoe arrangement 100, FIG. 5, perspective view of the kit 10 depicting a shuffleboard arrangement 105, and FIG. 6, a perspective view of the kit 10 depicting a bocce arrangement 110, according to a preferred embodiment of the present invention, are disclosed. Four (4) golf putting training drills are systemically developed which are all performed on the grass mat 20. The games are: horseshoes, table shuffleboard, deck shuffleboard, and bocce. Each of the developmental skill set games will be described herein. Each of these games can be played by two (2) or four (4) participants. Besides using the games as a supplemental training system for developing specific skills for improving the ability to putt a golf ball 42, the games can be for recreation and entertainment for non-golfers. Standard golf balls 42 of any color are also used, as would any conventional putter 41.

FIG. 4 depicts the horseshoe arrangement 100 which enables participants 40 to play a game similar to that of the common game of horseshoes. A common "U"-shaped horseshoe 101 fabricated from a durable plastic or similar material is supplied which is to be positioned upon the scoring section 19. Two (2) participants 40 play against each other from one (1) end of the court, and the other two (2) play against each other from the other end throughout the game Skill set developmental game 3 is a unique adaptation of horseshoes, comprised of four (4) participants 40, two (2) each on two (2) teams. The object of the game is herein described: Matches consist of one (1) game played to fifteen (15) points, unless otherwise specified by advance agreement amongst the participants 40, and provided the winner wins by two (2) points. Unlike the previous two (2) games, this game will be played on the putting mat 20 but with two (2) foam horseshoes 101 set up on opposite sides of the board. Each participant 40 or team will play with two (2) golf balls 42 of the same color. Participants 40 must putt the golf balls 42 from behind the "10 OFF" scoring border indicia line 14 to either side of the horseshoe 101. A coin flip will decide who will putt first. Participants 40 must move to the opposite end of the court after each round is complete unless competing in teams. Participants 40 competing in teams will stand opposite each other throughout the entirety of the game. Scoring is accomplished and recorded in the following manner: A golf ball 42 must be within a putter head's 41 length of the shoe to score or, alternately, four (4) inches as agreed upon by both participants 40 or by the teams. The closest golf ball 42 to the horseshoe 101 scores one (1) point. When there are two (2) golf balls 42 closer than the opponent's closest golf ball 42, it results in a score of two (2) points. A ringer is a golf ball 42 resting entirely within the horseshoe 101. One (1) ringer scores three (3) points. Two (2) ringers score six (6) points. One (1) ringer plus closest golf ball 42, if within four (4) inches of the same player, scores four (4) points. The participant 40 having two (2) ringers against one (1) for their opponent 40 scores three (3) points. In case each participant 40 has a ringer, the next closest golf ball 42, if within six (6) inches, scores one (1) point. All equals count as ties and no (0) points are scored. A golf ball 42 moved by an opponent's golf ball 42 must be counted in its new position.

FIG. 5 depicts the table shuffleboard arrangement 105 which enables participants 40 to play a game similar to that of the common game of table shuffleboard or deck shuffleboard (see herein below). Table Shuffleboard is comprised of two (2) teams with one (1) or two (2) participants 40 each. The object of the game is herein described: Matches consist of one (1) game played to twenty (20) points, unless otherwise specified; however, the winner must win by two (2) points. Each participant 40 or team will play with four (4) golf balls 42 of the same color. Participants 40 must putt the golf balls 42 from behind the "10 OFF" indicator line indicia 14. A coin flip will decide who will putt first. Participants 40 must move to the opposite end of the court after each round is completed, unless competing in teams. Participants 40 competing in teams will stand opposite each other throughout the entirety of the game. Scoring is accomplished and recorded in the following manner: The closest golf ball 42 to the end of the playing surface will receive points. As an example of this, if two (2) blue golf balls 42 are closer to the end of the board than one (1) red golf ball 42, both blue golf balls 42 will be awarded points. The only exception to this rule is if a ball 42 lies entirely in the "5 Point Zone" scoring section 19, and there is a golf ball 42 closer to the end of the playing surface in the "4 Point Zone" scoring section 19. In this case, the participant 40 with the golf ball 42 in the "5 Point Zone" scoring section 19 will receive five (5) points. Only one (1) participant 40 may acquire points during a turn. Point values are determined by the scoring indicia 13 marked within each scoring section 19. A golf ball 42 must rest entirely in the scoring section 13 to earn the point value. As an example, a ball 42 that touches the scoring border indicia line 14 between "1" and "2" will be awarded one (1) point. A ball 42 that does not completely cross the scoring border indicia line 14 into the "1 Point Zone" will be cleared from the board. Golf balls 42 that get knocked off of the playing surface or that roll off of the playing surface do not acquire any points.

The shuffleboard arrangement 105 depicted in FIG. 5 is also utilized to play deck shuffleboard which is comprised of four (4) participants 40; two (2) each on two (2) teams. The object of this game is herein described: Matches consist of one (1) game played to fifty (50), seventy-five (75), or one-hundred (100) points, unless otherwise specified. Each participant 40 or team will play with four (4) golf balls 42 of the same color. Participants 40 must putt the golf balls 42 from behind the "10 OFF" scoring border indicia line 14. A coin flip will decide who will putt first. Participants 40 must move to the opposite end of the court after each round is completed, unless competing in teams. Participants 40 competing in teams will stand opposite each other throughout the entirety of the game. Scoring is accomplished and recorded in the following manner: Point values are determined by the scoring indicia 13 marked within each scoring section 19. These zones are marked with various point indicators. A participant 40 or team will receive a negative ten (−10) points if their golf ball 42 rests in the "10 OFF" scoring section 18 at the end of a round. The exception to this rule is if the participant 40 goes into negative points. If the total points for a participant 40 or team were negative at the end of a round, they would have zero (0) points going into the next round. The game begins with a putt from the participant 40 who wins the coin flip attempting to score points in a scoring section 19 with their golf ball 42. The opponent 40 will then putt to outscore or knock their rival's ball 42 off of the mat 20 or into the "10 OFF" scoring section 18. A ball 42 that does not completely cross the scoring border indicia line 14 before the "10" point scoring section 19 will be cleared from the board. A golf ball 42 must rest entirely in the scoring section 19 to earn the point value. For an example, a ball 42 that touches the scoring border indicia line 14 between "10" and "8" will receive eight (8) points. If a golf ball 42 rests on the scoring border indicia line 14 between "7" and "10 OFF", that golf ball 42 will receive a negative ten (−10) points. If a golf ball 42 rests on the scoring border indicia line 14 behind the "10 OFF", that ball 42 is considered off of the playing field and will receive zero (0) points.

FIG. 6 depicts the bocce arrangement 110 which is played with four (4) participants, two (2) each on two (2) teams. The bocce arrangement 110 comprises a backstop 110 which stops a golf ball(s) 42 (see herein below). The backstop 111 is comprised of an "L"-shaped cardboard, plastic, or similar material further comprising an upper panel 112 and a lower panel 113. The lower panel 113 is positioned underneath the mat 20 to secure the backstop 11 and enable the upper panel 112 to stop golf balls 42. The backstop 111 is envisioned to be a least as wide as the mat 20. The object of the bocce arrangement 110 is herein described: The number of participants 40 is one (1) or two (2) each on two (2) rival teams. The game will be played on the putting mat 20 with the backstop 111 set up. A perfectly round, white spheroid, without the dimples associated with a standard golf ball 42 and with the approximate diameter of a golf ball 42, is used as the pallino (the target ball) when playing the modified game of bocce. Matches consist of one (1) game played to twelve (12) points, unless otherwise specified by advance agreement amongst the participants 40 and provided the winner wins by two (2) points. Each participant 40 or team will play with four (4) golf balls 42 of the same color. Participants 40 must putt the golf balls 42 from behind the "10 OFF" scoring border indicia line 14.

The match shall begin with the flip of a coin between the captains of each team. The winner of the coin flip may have the first putt of the pallino (the target spheroid) or choose the color of the balls 42. A participant 40 may putt the pallino any distance so long as the pallino passes the center line 15 of the court and does not hit the back wall. If a participant 40 fails to validly putt the pallino after one (1) attempt, the opposing team will have a chance to putt the pallino and put it in play. If the opposing team fails to putt the pallino past the center line 15, the pallino reverts to the original team. In either case, when the pallino has been properly put in play, the team who originally putted the pallino will putt the first golf ball 42. The team who originally putted the pallino, whether successfully or not, putts the first golf ball 42. If the golf ball 42 hits the backboard, that team must putt again. Otherwise, the participant 40 steps aside and their team does not putt again until the opposing team has either gotten one (1) of its golf balls 42 closer to the pallino or has putt all of its balls 42. The team whose golf balls 42 are closest to the pallino is called "inside" and the opposing team "outside." Whenever a team gets inside, it steps aside and lets the outside team play. The outside team putts until it beats (not ties) the opposing ball 42. This continues until both teams have used all of their golf balls 42 (a total of eight (8), or four (4) from each team). The team that scored last putts the pallino to begin the next frame. Should a player's golf ball 42 make contact with the backstop 111, the golf ball 42 is considered a dead ball 42 on impact and is removed from play until the end of the frame.

As the game is played and putting skills are developed, additional rules must be observed as outlined: 1) if the putted ball 42 comes to rest on the pallino or another ball 42 that is touching the back wall that putted ball 42 remains in play. The ball 42 touching the back wall is removed from play. If the pallino is touching the back wall it remains in play. 2) If a golf ball 42, after hitting the backstop 111, strikes a stationary golf ball 42, that stationary golf ball 42 shall be replaced in its original position. The putted ball 42 is removed from play. 3) If a golf ball 42 hitting the backstop 111 is not removed quickly enough and, as a result, strikes a moving ball 42 that likely would have hit the backstop 111, allowing the moving ball 42 to remain in play, that moving ball 42 remains in play where it comes to rest.

In regards to the "pallino," which is the name ascribed to the target spheroid, once the pallino has been validly put into play, it remains in play even if it hits the backstop 111. However, if the pallino is knocked out of the court or it is knocked in the front of the center line 15, the frame will end, no points will be awarded, and the game will resume with the same team putting the pallino.

Scoring is accomplished and recorded in the following manner: Only the "inside" team scores. One (1) point is given for each inside team's ball 42 that is closer to the pallino than any ball of the opposing team. If at the end of any frame the closest ball 42 of each team is equidistant from the pallino, the frame ends in a tie and no (0) points are awarded to either team. The team who scores twelve (12) points wins the game and, as previously indicated, the winner must have a two (2) point advantage.

Figure 7:
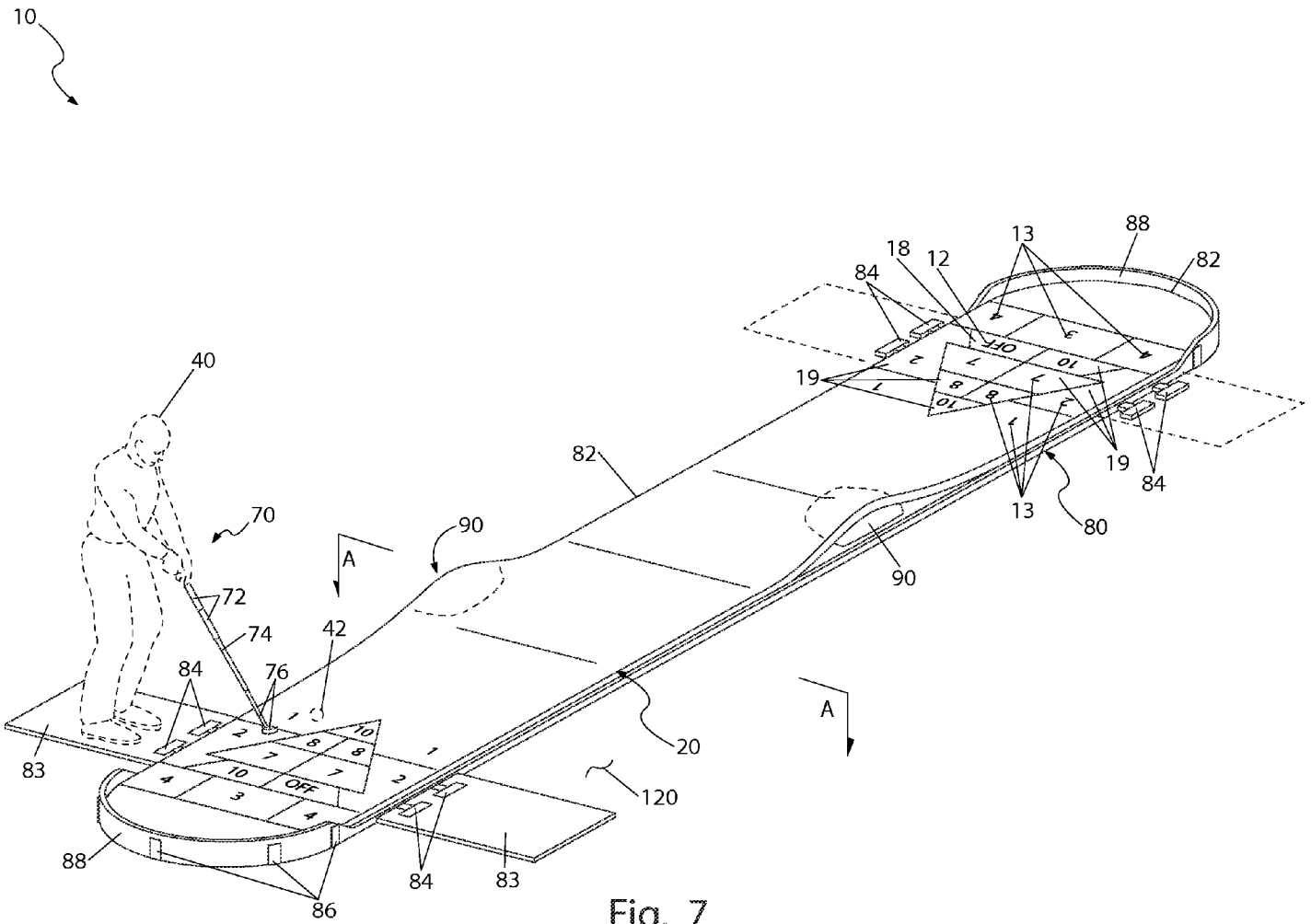
FIG. 7 is a perspective view of the training aid for practicing the skill of putting a golf ball in a straight direction 10 depicting a base mat 80 and a modular putter 70, according to an alternate embodiment of the present invention.
Figure 8:
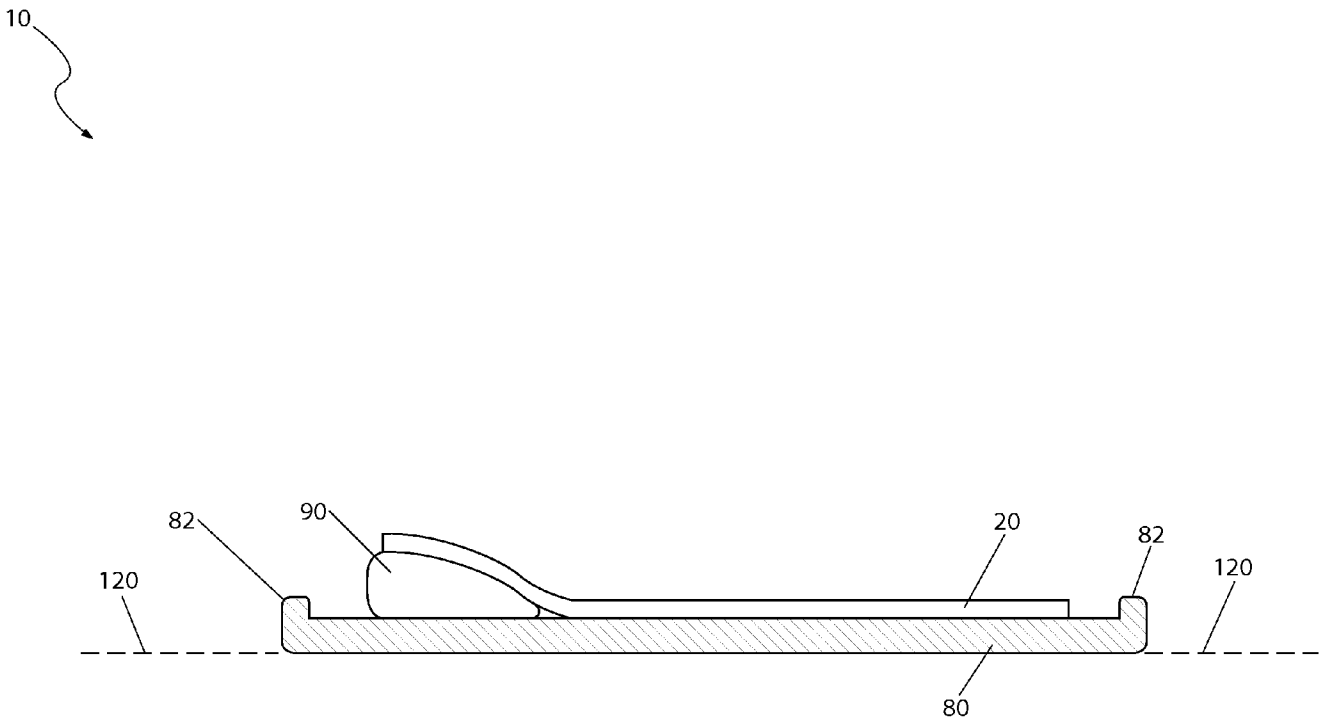
FIG. 8 is a section view of the training aid for practicing the skill of putting a golf ball in a straight direction 10 and the base mat 80 taken through section line A-A (see FIG. 5), according to an alternate embodiment of the present invention; and, FIG. 9 is a perspective view of the modular putter 70, according to an alternate embodiment of the present invention.

Referring now to FIG. 7, a perspective view of the kit 10 depicting a base mat 80 and a modular putter 70 and FIG. 8, a section view of the kit 10 installed upon the base mat portion 80, taken through section line A-A (see FIG. 7), according to an alternate embodiment of the present invention, are disclosed. The kit 10 may provide an enhanced practice experience by utilizing a non-skid base mat 80 and a modular putter 70 (see FIG. 6) in conjunction with the aforementioned mat 20. The base mat 80 comprises a perimeter rim 82, a pair of standing platforms 83, a plurality of hook-and-loop type straps 86, a pair of barriers 88, and a pair of profile inserts 90. The base mat 80 is to be positioned between the mat 20 and a supporting floor surface 120 and provides a high-friction non-skid stabilizing substrate on which to place the mat 20 and on which to stand during putting. The base mat 80 comprises a perimeter edge being parallel to and approximately six (6) inches wider on each long side than the mat 20 and forming a semi-circular shape around end portions of said mat 20. The edge region of the base mat 80 further comprises an upwardly protruding rim 82 which extends all around said perimeter region being approximately one (1) inch high which provides a retaining means to golf balls 42 which exit the top surface of the mat 20 during use. The base mat 80 is fabricated of sheet rubber or a rubber and cloth lamination being capable of being compactly rolled or folded for convenient storage.

The base mat 80 further provides an attachment means to a pair of standing platforms 83 which enable a stable surface on which a participant 40 may stand during putting. The standing platforms 83 are fabricated of similar materials as the aforementioned base mat 80. The standing platforms 83 are removably attached to a perimeter edge of said base mat 80 at corner portions upon right and left long sides of the base mat 80 via integrally-molded "T"-shaped locking features 84 or equivalent locking geometric features which are integrally molded to the base mat 80 and protrude perpendicularly from each perimeter edge.

An additional means to retain a golf ball 42 during play is provided along each semi-circular end portions of the base mat 80 via respective vertical barriers 88 which extend at right angles from the base mat 80 approximately three (3) inches high. Said barriers 88 are held intimately against the arcuate end portions of said base mat 80 via a plurality of fastening hook-and-loop straps correspondingly bonded or sewn to said barriers 88 and end portions of the base mat 80. The barriers 88 are fabricated of semi-rigid extruded plastic sheet and are capable of being rolled compactly for convenient storage.

The base mat 80 also provides a means to emulate a variable topographic profile via a pair of profile inserts 90 comprising hollow or solid arcuate forms approximately one (1) to three (3) inches high which are to be inserted between the base mat 80 and the mat 20. Once installed, said profile inserts 90 causes the mat 20 to deflect upwardly so as to simulate topographic variations typically found on a golf course. One (1) or both profile inserts 90 may be positioned along either side edge of the mat 20 by a participant 40 to create a more challenging putting surface. The profile inserts 90 are fabricated of semi-rigid plastic in a molding process and may be introduced having a variety of sizes and shapes based upon a participant 40 preference. Said profile inserts 90 are generally hyperbolically-shaped with gradually tapering edges so as to minimize unsupported areas between the base mat 80 and the profile inserts 90. The profile insert 90 is depicted herein as being inserted between the mat 20 and the base mat 80 being positioned subjacent to an edge portion of the mat 20 which creates topical variations within the mat 20 to enhance a putting experience.

Figure 9:
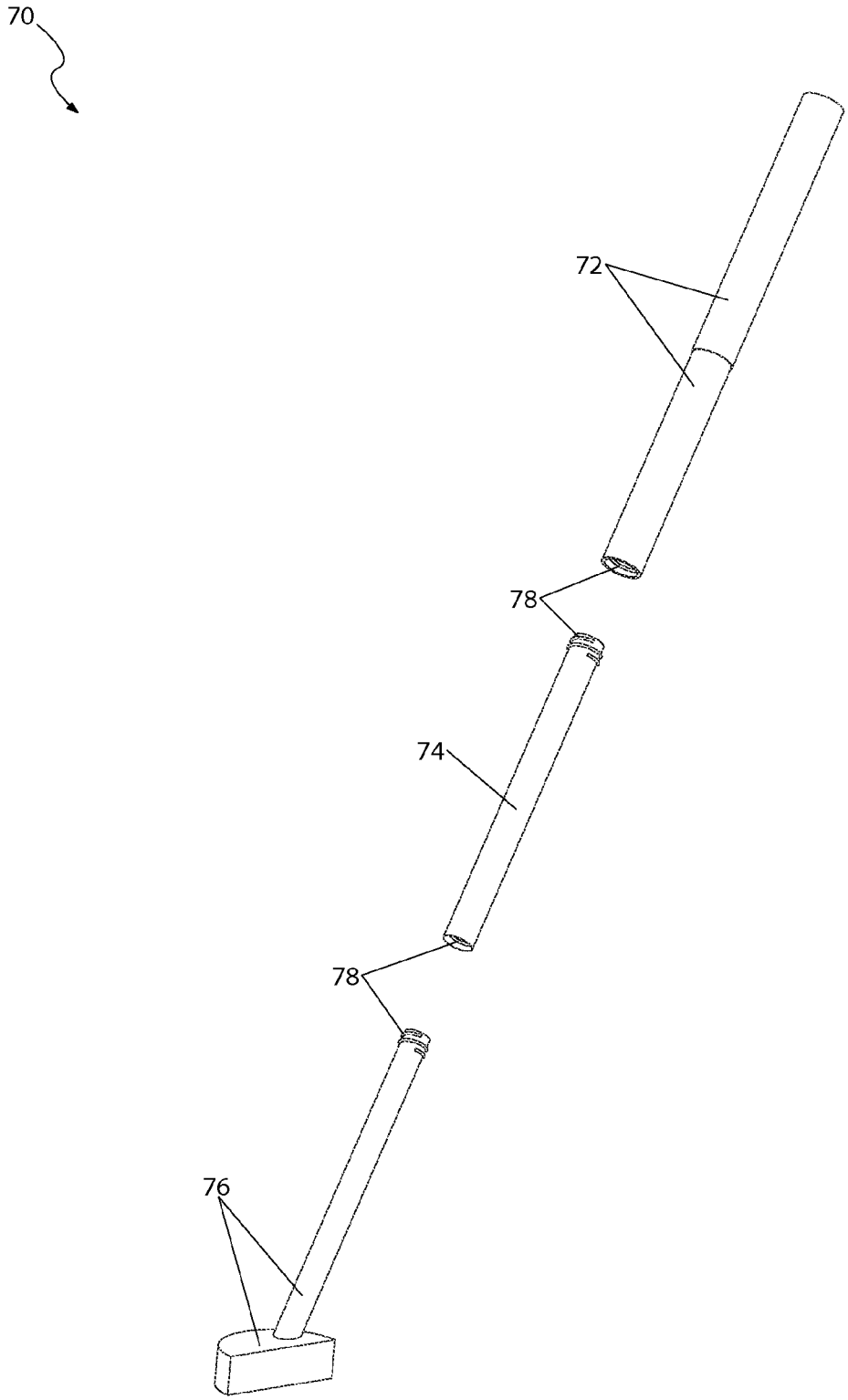

Referring now to FIG. 9, a perspective view of the modular putter 70, according to an alternate embodiment of the present invention, is disclosed. The kit 10 comprises a compact modular practice putter 70 comprising of three (3) interconnecting sections including a handle section 72, a middle section 74, and a head section 76. The modular practice putter 70 is comprised of similar materials and design as conventional putters 41; however, said modular practice putter 70 further provides a collapsible shaft portion allowing compact storage. Once assembled together, said sections 72, 74, 76 constitute a unitary putting device which provides similar functionality as that of a conventional putter 41. The sections 72, 74, 76 are removably attached to each other using a threaded connection or the like which allows the modular practice putter 70 to be stored within a carrying case or similar storage device when not in use. The handle section 72 is comprised of a tubular shaft with a grippable exterior surface and a proximal end portion which comprises an inner threaded portion 78 which enables interconnection to the middle section 74. The middle section 74 is also a tubular shaft which is slightly smaller in diameter to the handle section 72 to enable an interconnection. A distal upper exterior surface of the middle section 72 comprises a threaded portion 78 which engages the proximal end of the handle section 72. A proximal inner surface of the middle section 74 comprises threaded portion 78 which enables interconnection to the head section 76. The head section 76 comprises a tubular shaft and a common putting head for striking a golf ball 42. A distal exterior surface of the head section 76 comprises a threaded portion 78 which engages the inner proximal end of the middle section 74.

The preferred embodiment of the present invention can be utilized by the common user in a simple and effortless manner with little or no training. After initial purchase or acquisition of the kit 10, it would be installed as indicated in FIG. 1.

The method of utilizing the kit 10 may be achieved by performing the following steps: placing the mat 20 on a desired level surface with the scoring sections 19 oriented upwardly; practicing putting as desired via striking a golf ball 42 towards a desired target the imprinted scoring section 19 on the mat 20; the participant 40 may also play a desired abovementioned game such as horseshoe arrangement 100, shuffleboard arrangement 105, or bocce arrangement 110; and, utilizing the kit 10 to practice putting a golf ball 42 with a golf club 41.

The alternate embodiment of the present invention can be utilized by the common user in a simple and effortless manner with little or no training. After initial purchase or acquisition of the kit 10, it would be installed as indicated in FIG. 7.

The method of utilizing the kit 10 with the base mat 80 may be achieved by performing the following steps:

The method for utilizing the base mat portion 80 may be achieved by performing the following additional steps: unrolling the base mat 80 upon a floor surface 120; placing the mat 20 upon a top surface of the base mat 80; centering said mat 20 within the rim portions 82 of said base mat 80; attaching one (1) or both standing platforms 83 to the locking feature portions 84 based upon a desired putting location; inserting one (1) or both profile inserts 90 between the mat 20 and the base mat 80 at a desired location or locations to produce a desired topical profile; affixing the barriers 88 to the semi-circular end portions of the base mat 80 using the hook-and-loop straps 86; standing upon a standing platform 83 to strike the golf ball 42 using a conventional putter 41 or the modular putter 70; and, performing putting practice or a putting game as described above.

The method for utilizing the modular practice putter 70 may be achieved by performing the following additional steps: assembling the modular practice putter 70 by assembling or deploying the putter sections 72, 74, 76 into a unitary linear form; and, utilizing said modular practice putter 70 to perform normal putting practice or a putting game as described above.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A supplemental training aid for practicing putting of a golf ball for improving said putting, comprising:

a mat, further comprising a playing surface, a primary backing, a secondary backing adhesively attached to said primary backing, a length, and a width;

a first plurality of golf balls;

a putter assembly;

a plurality of auxiliary items; and, indicia imprinted thereon said playing surface of said mat;

wherein said indicia further comprises scoring section indicia and scoring indicating indicia, said indicia is located on each a first end and a second end of said mat;

wherein said secondary backing is a flexible non-skid and slip-resistant material, capable of enabling said mat to roll up for storage;

wherein said supplemental training aid is configured to enable a selectable number of games to be played therewith; and, wherein said plurality of auxiliary items are specific to an individual one of said selectable number of games.

2. The training aid of claim 1, wherein said playing surface of said mat is an artificial grass woven or stitched into said primary backing, further comprising a texture and size of a golf putting green.

3. The training aid of claim 2, wherein said length is ten feet and said width is two feet.

4. The training aid of claim 3, wherein said scoring section indicia is shaped in a deck shuffleboard pattern and a tabletop shuffleboard pattern overlaying said deck shuffleboard pattern and including a plurality of segmented scoring sections wherein each said scoring sections are labeled with score indicating indicia.

5. The training aid of claim 4, wherein said selectable number of games includes a bocce game, a horseshoe game, and a shuffleboard game.

6. The training aid of claim 5, wherein said auxiliary items associated with said bocce game further comprises:

a bumper guard for removable attachment about a periphery of said first end and said second end of said mat;

a second plurality of golf balls of a different color than said first plurality of golf balls for opposing game play; and, a pallino.

7. The training aid of claim 5, wherein said auxiliary items associated with said horseshoe game further comprises a plurality of horseshoes fabricated out of a soft and flexible material.

8. The training aid of claim 4, wherein said putter assembly further comprises a multi-piece detachable shaft and head;

wherein one piece of said multi-piece shaft comprises an outer surface with a grip.

9. A supplemental training aid for practicing putting of a golf ball for improving said putting, comprising:

a mat, further comprising a playing surface, a primary backing, a secondary backing adhesively attached to said primary backing, a mat length, and a mat width;

a base mat, comprising a planar resilient body, a rim upstanding from a perimeter of said body, a base mat length, and a base mat width;

at least two standing platforms removably attachable to a side surface of said base mat with a platform attachment means;

a first plurality of golf balls;

a putter assembly;

a plurality of auxiliary items; and, indicia imprinted thereon said playing surface of said mat;

wherein said mat is placed on said base mat to prevent movement of said mat such that said mat is fully within said perimeter of said base mat;

wherein said secondary backing is a flexible non-skid and slip-resistant material, capable of enabling said mat to roll up for storage;

wherein said base mat comprises a non-slip backing surface capable of enabling said base mat to roll up for storage;

wherein said indicia further comprises scoring section indicia and scoring indicating indicia, said indicia is located on each a first end and a second end of said mat;

wherein said at least one standing platform is removably attachable to said base mat adjacent to both said first end and said second end of mat;

wherein said supplemental training aid is configured to enable a selectable number of games to be played therewith; and, wherein said plurality of auxiliary items are specific to an individual one of said selectable number of games.

10. The training aid of claim 9, wherein said base mat further comprises a rounded first end and a rounded second end and a base mat length and a base mat width approximately six inches greater than said mat length and said mat width, respectively.

11. The training aid of claim 10, further comprising a pair of barriers removably attachable to said first end and said second end of said base mat;

wherein said pair of barriers extend upwardly from said rim of said base mat when attached thereto; and, wherein when said mat is placed within said base mat, said pair of barriers are to provide additional means of preventing errant golf balls from leaving said mat and said base mat.

12. The training aid of claim 11, wherein said platform attachment means further comprises:

at least one integrally molded "T"-shaped protrusion extending outward from said surface of said base mat; and, a corresponding receiver located on each of said standing platforms.

13. The training aid of claim 12, wherein said playing surface of said mat is an artificial grass woven or stitched into said primary backing, further comprising a texture and size of a golf putting green.

14. The training aid of claim 13, further comprising a plurality of profile body members having gently tapering edges;

wherein said foam body members can be placed between said mat and said base mat at selected locations to provide a contoured topography to said playing surface.

15. The training aid of claim 14, wherein said mat length is ten feet and said mat width is two feet.

16. The training aid of claim 15, wherein said scoring section indicia is shaped in a deck shuffleboard pattern and a tabletop shuffleboard pattern overlaying said deck shuffleboard pattern and including a plurality of segmented scoring sections wherein each said scoring sections are labeled with score indicating indicia.

17. The training aid of claim 16, wherein said selectable number of games includes a bocce game, a horseshoe game, and a shuffleboard game.

18. The training aid of claim 17, wherein said auxiliary items associated with said bocce game further comprises:

a bumper guard for removable attachment about a periphery of said first end and said second end of said mat;

a second plurality of golf balls of a different color than said first plurality of golf balls for opposing game play; and, a pallino.

19. The training aid of claim 17, wherein said auxiliary items associated with said horseshoe game further comprises a plurality of horseshoes fabricated out of a soft and flexible material.

20. The training aid of claim 16, wherein said putter assembly further comprises a multi-piece detachable shaft and head;

wherein one piece of said multi-piece shaft comprises an outer surface with a grip.

* * * * *